US008734575B2

(12) United States Patent
Tanaka et al.

(10) Patent No.: US 8,734,575 B2
(45) Date of Patent: May 27, 2014

(54) AIRFLOW CONTROLLING DEVICE AND METHOD

(75) Inventors: Masato Tanaka, Tokyo (JP); Mayumi Miura, Tokyo (JP); Kenji Akai, Tokyo (JP); Shuji Sawada, Tokyo (JP); Yasuko Horiguchi, Tokyo (JP)

(73) Assignee: Azbil Corporation, Tokyo (JP)

( * ) Notice: Subject to any disclaimer, the term of this patent is extended or adjusted under 35 U.S.C. 154(b) by 0 days.

(21) Appl. No.: 13/176,971

(22) Filed: Jul. 6, 2011

(65) Prior Publication Data

US 2012/0020831 A1 Jan. 26, 2012

(30) Foreign Application Priority Data

Jul. 22, 2010 (JP) ..... 2010-164662

(51) Int. Cl.
*B03C 3/40* (2006.01)
*B01D 53/02* (2006.01)

(52) U.S. Cl.
USPC ..... 96/108; 96/83; 96/223; 96/243

(58) Field of Classification Search
USPC ..... 96/15, 83, 108, 223, 243; 422/1, 24, 28, 422/121, 123, 82.05; 62/317, 419, 449; 435/15; 55/428; 588/301, 311
See application file for complete search history.

(56) References Cited

U.S. PATENT DOCUMENTS

| | | | | |
|---|---|---|---|---|
| 4,549,472 | A | 10/1985 | Endo et al. | |
| 5,086,692 | A * | 2/1992 | Welch et al. | 454/187 |
| 2006/0130663 | A1 * | 6/2006 | Joshi et al. | 96/224 |

FOREIGN PATENT DOCUMENTS

| | | | |
|---|---|---|---|
| JP | S60-71830 | A | 4/1985 |
| JP | 3012235 | B1 | 2/2000 |
| JP | 2005-106296 | A | 4/2005 |

OTHER PUBLICATIONS

N. Hasegawa, et al., Instantaneous Bioaerosol Detection Technology and Its Application, Yamatake Company, Ltd., Azbil Technical Review, Dec. 2009, pp. 2-7.

Japanese Office Action, dated Dec. 13, 2013, which issued during the prosecution of Japanese Patent Application No. 2010-164662, which corresponds to the present application.

* cited by examiner

*Primary Examiner* — Monzer R Chorbaji
(74) *Attorney, Agent, or Firm* — Troutman Sanders LLP

(57) ABSTRACT

The airflow controlling device includes a bacteria counting portion counting bacteria of a controlled space; a first smoothing processing portion performing a first smoothing process on the bacteria count; a second smoothing processing portion performing a second smoothing process on the bacteria count; a bacteria reducing capability storing portion storing a bacteria reducing capability relative to each flow rate; a first flow rate evaluating portion selecting a flow rate matching a bacteria reducing capability compatible with an increase in a bacteria count forecasted from the processing result of the first smoothing processing portion; a second flow rate evaluating portion selecting a flow rate matching a bacteria reducing capability compatible with an increase in a bacteria count forecasted from the processing result of the second smoothing processing portion; and a flow rate determining portion selecting a flow rate into the controlled space based on the flow rates selected by the first and second flow rate evaluating portions.

8 Claims, 5 Drawing Sheets

| Flow rate Vi | V1 = 0.50 | V2 = 1.50 | V3 = 4.50 | V4 = 10.0 |
|---|---|---|---|---|
| Required time Si | S1 = 298 | S2 = 126 | S3 = 41 | S4 = 15 |

AIRFLOW CONTROLLING DEVICE AND METHOD

CROSS REFERENCE TO RELATED APPLICATIONS

The present application claims priority under 35 U.S.C. §119 to Japanese Patent Application No. 2010-164662, filed on Jul. 22, 2010, which is incorporated herein by reference.

FIELD OF TECHNOLOGY

The present invention relates to a blowing controlling device and method for controlling a flow rate to a controlled space, relating to an air-conditioning system for reducing bacteria, such as germs, that exist in the controlled space, in a foodstuffs factory, pharmaceuticals product factory, hospital, or the like, that must be hygienic.

BACKGROUND OF THE INVENTION

In hygienic facilities such as foodstuff factories, pharmaceutical product factories, hospitals, or the like, there is a problem in that there is the potential for incursion of airborne bacteria or adhesive bacteria into the room accompanying entry and exit of people and objects, where the adhesion and the growth of airborne bacteria and adhesive bacteria on wall surfaces or devices within the room may cause the room to become contaminated. The room becoming contaminated is a problem that may lead to decreased product quality, or, in the case of a foodstuff, food poisoning.

Conventionally this problem has often been handled through the use of a method wherein circulating air and outside air has been filtered through an air purifying filter before being blown into the room.

Additionally, as another method, there has been an air-conditioning system proposed wherein an ultraviolet radiation device and an antimicrobial spray device have been provided, as means for reducing bacteria in circulating ducts and air supply ducts, to not only perform ultraviolet sterilization of bacteria in the air, but also to spray the antimicrobial solution within the room so as to maintain an antimicrobial atmosphere (See Japanese Unexamined Patent Application Publication 2005-106296 ("JP '296").

When air exchange is performed through blowing into the room air that has been filtered by an air cleaning filter, as described above, this consumes the transporting power of the air-conditioner. Conventionally, the reliable elimination of bacteria has been the priority, so operations have been performed with the airflow set on the high side so as to have a sufficient margin. In this case, even if the bacteria were actually reduced adequately, still the operation would have the high air flow, essentially resulting in waste of the transporting power. However, because variations in the number of bacteria do not increase or decrease in accordance with measurable causes, it has been difficult to set the flow rate to the low side in order to conserve the transporting power.

Additionally, even when bacteria reducing means, such as the air-conditioning system disclosed in JP '296, are used, when setting the blower flow, setting on the high side, with the emphasis on the reliable elimination of bacteria, has been unavoidable, even when aware of the waste of the transporting power.

The present invention was created in order to solve the problem set forth above, and the object thereof is to provide a blowing controlling device and method, in an air-conditioning system provided with bacteria reducing means, able to reduce the amount of air transporting power of blowing devices, and the like, for air-conditioning equipment for air exchange and for bacteria reducing equipment, in accordance with the degree of margin in the number of bacteria.

SUMMARY OF THE INVENTION

A blowing controlling device according to the present invention includes bacteria counting means for counting bacteria of a controlled space; first smoothing processing means for performing a first smoothing process, established by a first smoothing time index, on the bacteria count; second smoothing processing means for performing a second smoothing process, established by a second smoothing time index, on the bacteria count; bacteria reducing capability storing means for storing in advance the bacteria reducing capability of bacteria reducing means, relative to each flow rate, into the controlled space; first flow rate evaluating means for referencing the bacteria reducing capability storing means to select a flow rate matching a bacteria reducing capability compatible with an increase in bacteria forecasted from the processing result of the first smoothing processing means; second flow rate evaluating means for referencing the bacteria reducing capability storing means to select a flow rate matching a bacteria reducing capability compatible with an increase in bacteria forecasted from the processing result of the second smoothing processing means; and flow rate determining means for selecting a flow rate into the controlled space based on the flow rate selected by the first flow rate evaluating means and the flow rate selected by the second flow rate evaluating means.

Additionally, a blowing controlling device according to the present invention has bacteria, counting means for counting bacteria of a controlled space; first smoothing processing means for performing a first smoothing process, established by a first smoothing time index, on the bacteria count; second smoothing processing means for performing a second smoothing process, established by a second smoothing time index, on the bacteria count; bacteria reducing capability storing means for storing in advance the bacteria reducing capability of bacteria reducing means, relative to each flow rate, into the controlled space; first arrival time estimating means for estimating a time until arrival of the bacteria count at an upper limit bacteria, count, from the processing result by the first smoothing processing means; second arrival time estimating means for estimating a time until arrival of the bacteria count at an upper limit bacteria, count, from the processing result by the second smoothing processing means; and flow rate determining means for referencing the bacteria reducing capability storing means to select a flow rate that matches a bacteria reducing capability able to handle an increase in the bacteria count that is forecasted from the time estimated by the first arrival time estimating means and the time estimated by the second arrival time estimating means, and for defining the selected flow rate as the flow rate into the controlled space.

Additionally, in one structural example of a blowing controlling device according to the present invention, the bacteria reducing capability is expressed as the time required to reduce the bacteria count in the controlled space from an upper limit bacteria count to a specific proportion.

A blowing controlling method according to the present invention has steps of a bacteria counting step for counting bacteria of a controlled space; a first smoothing processing step for performing a first smoothing process, established by a first smoothing time index, on the bacteria count; a second smoothing processing step for performing a second smoothing process, established by a second smoothing time index, on the bacteria count; a first flow rate evaluating step for referencing bacteria reducing capability storing means, which store in advance bacteria reducing capabilities of bacteria reducing means corresponding to each flow rate into the controlled space, to select a flow rate matching a bacteria reducing capability compatible with an increase in bacteria forecasted from the processing result of the first smoothing processing step; a second flow rate evaluating step for referencing the bacteria reducing capability storing means to select a flow rate matching a bacteria reducing capability compatible with an increase in bacteria forecasted from the processing result of the second smoothing processing step; and a flow rate determining step for selecting a flow rate into the controlled space based on the flow rate selected by the first flow rate evaluating step and the flow rate selected by the second flow rate evaluating step.

Additionally, a blowing controlling method includes a bacteria counting step for counting bacteria of a controlled space; a first smoothing processing step for performing a first smoothing process, established by a first smoothing time index, on the bacteria count; a second smoothing processing step for performing a second smoothing process, established by a second smoothing time index, on the bacteria count; a first arrival time estimating step for estimating a time until arrival of the bacteria count at an upper limit bacteria count, from the processing result by the first smoothing processing step; a second arrival time estimating step for estimating a time until arrival of the bacteria count at an upper limit bacteria count, from the processing result by the second smoothing processing step; a flow rate determining step for referencing bacteria reducing capability storing means, which store in advance bacteria reducing capabilities of bacteria reducing means corresponding to each flow rate into the controlled space, to select a flow rate that matches a bacteria reducing capability able to handle an increase in the bacteria count that is forecasted from the time estimated by the first arrival time estimating means and the time estimated by the second arrival time estimating means, and for defining the selective flow rate as the flow rate into the controlled space.

The present invention enables the safe performance of conservation of air transporting power of an air conditioner or a blowing device in accordance with a degree of margin of a bacteria count, through enabling the flow rate to be set in consideration of the variability of the speed of change of the bacteria count, through essentially performing a plurality of decisions based on smoothing processes through different smoothing time indices. The present invention is able to control the waste of air transporting power such as when the maximum flow rate is always selected.

DETAILED DESCRIPTION OF THE INVENTION

Figure 1:
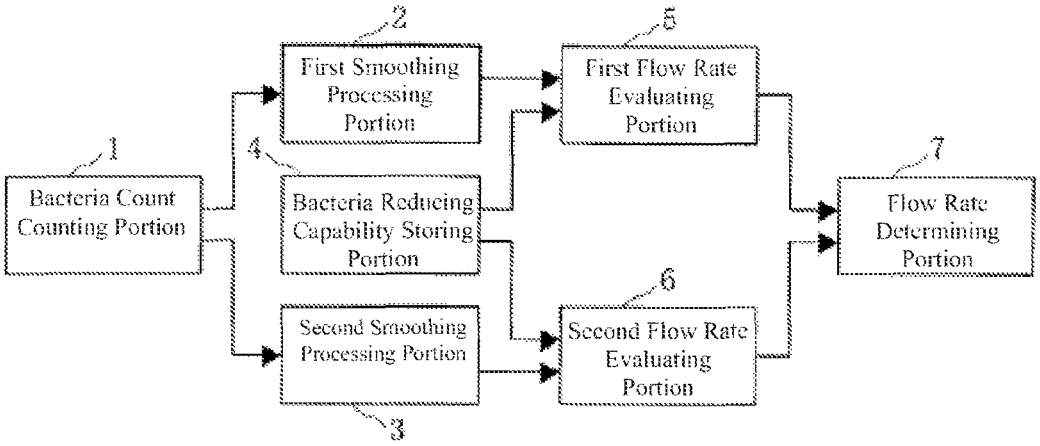
FIG. 1 is a block diagram illustrating a structure of a blowing controlling device according to an example of the present invention.

In the present invention, bacteria are measured through arranging, within a room, the Instantaneous Microbe Detector, developed by BioVigilant Systems in the United States (Norio Hasegawa, et al., "Instantaneous Bioaerosol Detection Technology and Its Application," Yamatake Company, Ltd., azbil Technical Review, December 2009, pg. 2-7, 2009). The bacteria count will vary randomly depending on the season, temperature, humidity, number of occupants within the room, and so forth.

Because that which is performed in the present invention is control of blowing in air exchange in an air conditioner or control of blowing of a glowing device, this can be considered to be taking advantage of the concept of forecast model control to forecast increases in bacteria counts to make decisions so that air exchange and bacteria reduction are not too late. However, when it comes to bacteria counts, it is difficult to create models for model forecasting, and that which is particularly difficult is narrowing down the speed of change of the bacteria counts.

Given this, in the present invention, the flow rate in the blowing control is divided into at least two stages, including a low-energy mode. Moreover, the bacteria reduction capability is researched in advance and stored for each flow rate. This is quantified, for example, in terms of a reduction capability of $N/m^3 \cdot min$, for a flow rate of $A \cdot m^3/min$.

Following this, a method for smoothing the count data for the bacteria count is used, divided into a plurality of different smoothing time indices (time constants if the smoothing process is a one-stage delay filter process). At this time, the smoothing time index is set in consideration of the variability of the speed of change of the bacteria count. For example, there may be a split into a smoothing time index that is set from past data so that the bacteria reduction can keep up when the bacteria count changes at the maximum speed, and a smoothing time index that is established from past data so that the bacteria reduction can keep up when the bacteria count changes at a slow speed that has high statistical reliability.

Moreover, unnecessary, excess air transporting power can be conserved by increasing and decreasing the flow rate in the blowing control based on whether or not the bacteria reducing capability is able to handle the increase in bacteria that is forecasted from the results of a plurality of smoothing processes, taking the variability of the speed of change in the bacteria into account.

Forms for carrying out the present invention are explained next in reference to the figures. The example set forth below is not used in a space wherein bacteria, such as germs, are reduced perfectly to zero, but rather normally is used in an adjacent or connected peripheral space. That is, in order to create a perfectly germ-free environment such as in a pharmaceuticals product factory, it is necessary to have surrounding semi-germ-free spaces, and preferably the example below is considered to be applicable to the semi-germ-free spaces. In this type of semi-germ-free space, the bacteria count within the room increases in accordance with the entry/exit of people and objects, as described above. However, this does not mean that the increase in the bacteria count is proportional to the movement of people or objects in and out, and thus it is difficult to know the bacteria count without counting the bacteria in the form of embodiment below. An air cleaning filter, for filtering the air exchange, is used as the bacteria reducing means.

FIG. 1 is a block diagram illustrating a structure for an airflow controlling device according to an example of the invention. The blowing controlling device includes a bacteria counting portion 1 for counting bacteria of a controlled space in real time; a first smoothing processing portion 2 for performing a first smoothing process, established by a first smoothing time index, on the bacteria count; a second smoothing processing portion 3 for performing a second smoothing process, established by a second smoothing time index, on the bacteria count; a bacteria reducing capability storing portion 4 for storing in advance the bacteria reducing capability of bacteria reducing means, relative to each flow rate, into the controlled space; a first flow rate evaluating portion 5 for referencing the bacteria reducing capability storing portion 4 to select a flow rate matching a bacteria reducing capability compatible with an increase in a bacteria count forecasted from the processing result of the first smoothing processing portion 2; a second flow rate evaluating portion 6 for referencing the bacteria reducing capability storing portion 4 to select a flow rate matching a bacteria reducing capability compatible with an increase in a bacteria count forecasted from the processing result of the second smoothing processing portion 3; and a flow rate determining portion 7 for selecting a flow rate into the controlled space based on the flow rate selected by the first flow rate evaluating portion 5 and the flow rate selected by the second flow rate evaluating portion 6.

Figure 2:
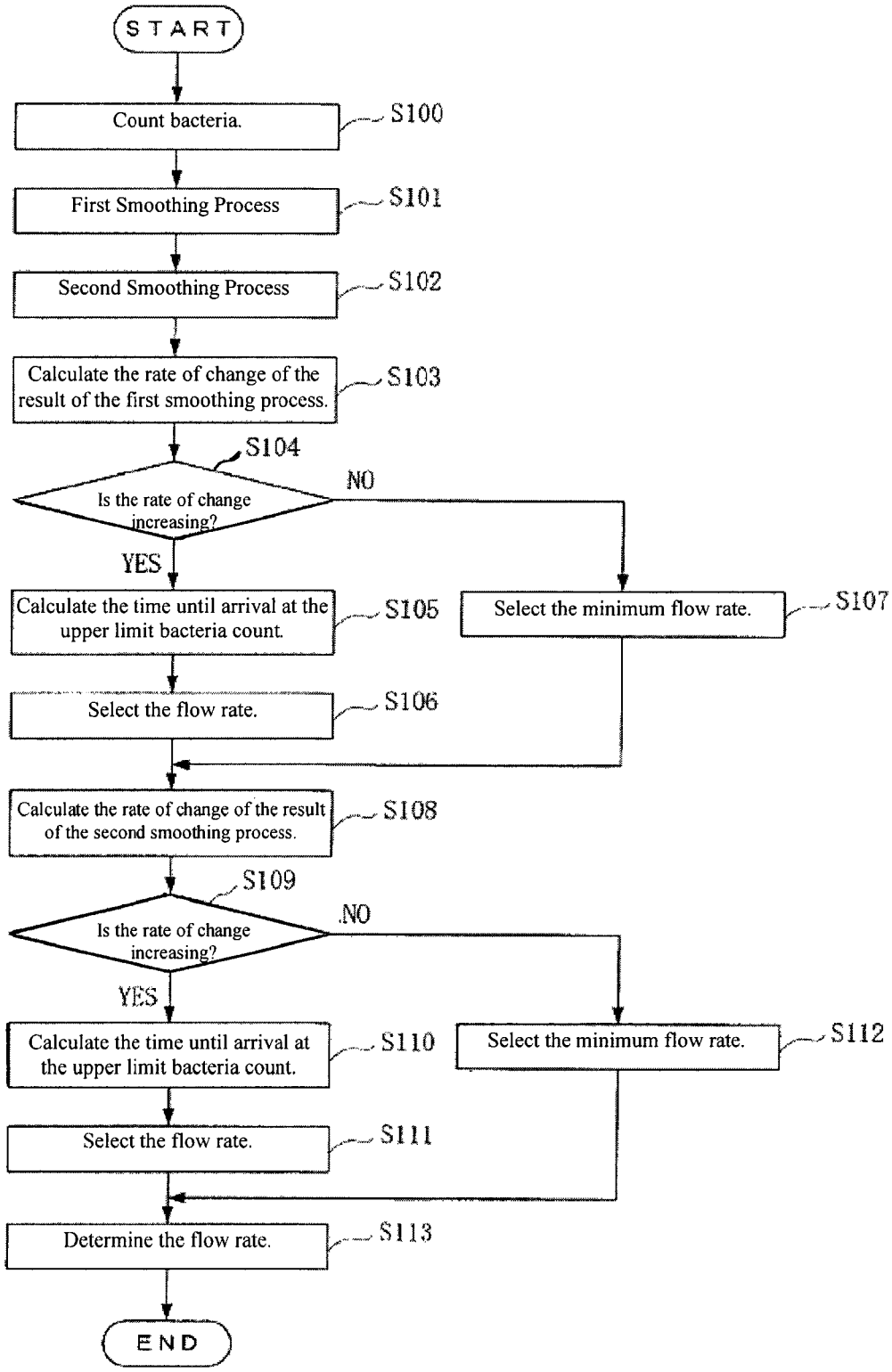
FIG. 2 is a flowchart illustrating the operation of the blowing controlling device according to an example of the present invention.
Figures 3, 4:
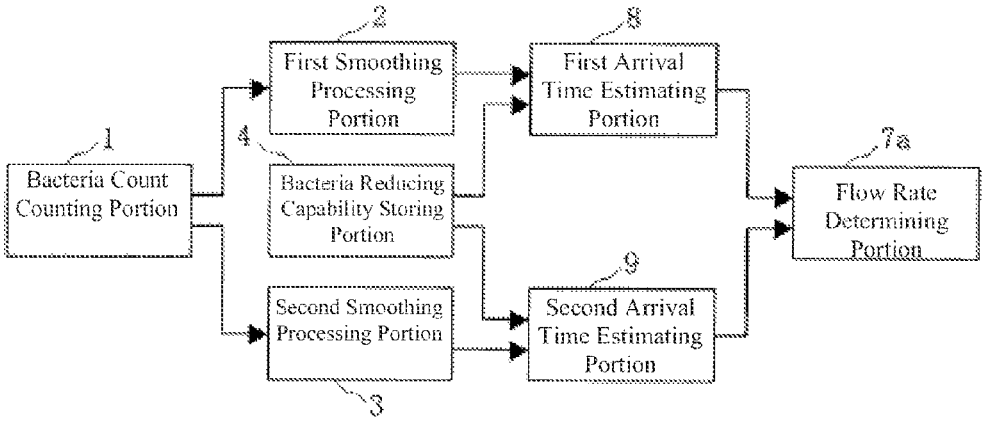
FIG. 3 is a diagram illustrating one example of information stored in a bacteria reducing capability storing portion in an example of the present invention.
FIG. 4 is a block diagram illustrating a structure of a blowing controlling device according to another example of the present invention.

FIG. 2 is a flowchart illustrating the operation of an airflow controlling device. The bacteria reducing capability storing portion 4 stores in advance a flow rate Vi ($m^3$/min) of the airflow control of the air-conditioner in air exchange for filtering through the air cleaning filter, and the required time Si (min) for reducing the bacteria count in half from an upper limit bacteria count NV at the bacteria reducing capability corresponding to the flow rate Vi. FIG. 3 illustrates one example of information stored in the bacteria reducing capability storing portion 4. The lower the flow rate, the less the transporting power that is consumed, thereby saving energy; however, the ability to reduce the bacteria count by half is reduced.

The bacteria count counting portion 1 counts, as Nj (microbes/$m^3$), the number of microbes per unit volume and per unit time (for example/min), detected with a specific timing Tj in the controlled space (hereinafter termed the semi-germ-free space) for which air handling is performed by an air conditioner or a blowing device (FIG. 2, step S100). An Instantaneous Microbe Detector is used as the bacteria count counting portion 1. The air that is subject to counting by the bacteria count counting portion is, for example, air of a typical location within a semi-germ-free space.

A first smoothing processing portion 2 performs a first smoothing process, established by a first smoothing time index T1, on the bacteria count Nj, counted by the bacteria count counting portion 1 (Step S101). The first smoothing time index T1 is determined in advance so as to enable the detection to keep up with changes when the bacteria count changes at the maximum speed state that can be envisioned from past data. That is, the object is to detect accurately dangerous increasing trends that can be viewed as being realistic numeric quantities. Here the first smoothing process is a one-stage delay filter process, where the first smoothing time index T1 is defined as the one-stage filter time constant T1=41 min. Here T1=41 min, is a value that is the same as the required time S3=41 min. that is stored in the bacteria reducing capability storing portion 4. The processing result by the first smoothing processing portion 2 is defined as D1.

A second smoothing processing portion 3 performs a second smoothing process, established by a second smoothing time index T2, on the bacteria count Nj, counted by the bacteria count counting portion 1 (Step S102). The second smoothing time index T2 is determined in advance so as to be able to reflect changes when there is a change in the bacteria count at a gradual speed, with high statistical reliability, from past data. That is, the object is to be able to detect reliably, without a decision that is unnecessarily on the safe side, such as at the beginning of an increasing trend. Here the second smoothing process is a one-stage delay filter process, where the second smoothing time index T2 is defined as the one-stage filter time constant T2=298 min. Here T2=298 min. is a value that is the same as the required time S1=298 min. that is stored in the bacteria reducing capability storing portion 4. The processing result by the second smoothing processing portion 3 is defined as D2.

A first flow rate evaluating portion 5 calculates a rate of change ΔD1 of the result D1 of performing the first smoothing process (Step S103). If the processing result of the previous cycle of the first smoothing processing portion 2 is $D1_{OLD}$, then the rate of change ΔD1 can be calculated through ($D1-D1_{OLD}$)/unit time (for example, 1 min).

The first flow rate evaluating portion 5, when the ΔD1 calculated in Step S103 is an increasing trend when compared to the rate of change calculated the previous time (YES in Step S104), calculates the time R1 until the bacteria, count arrives at an upper limit bacteria count NU, assuming that this rate of change ΔD1 will continue (Step S105). It is possible, of course, to calculate the time R1 as long as D1, which indicates the present bacteria count, and the rate of change ΔD1 thereof are known.

The first flow rate evaluating portion 5 obtains, from the bacteria reducing capability storing portion 4, the flow rate Vi_1 that corresponds to the largest required time of all of the required times that are smaller than α1×R1 (where α1 is a specific design constant) of those required times S1 that are stored in the bacteria reducing capability storing portion 4 (Step S106). The aforementioned bacteria reducing capability is given as the required time until the bacteria count is reduced by half from the upper limit bacteria count NU, and thus if the design is to α1=1.0, then it is fully possible to select a flow rate wherein there will be no problems. Note that in Step S104, if the rate of change ΔD1 does not have an increasing trend, then the updating of the flow rate Vi_1 through Step S105 and S106 is not performed, but rather the minimum flow rate is selected (Step S107).

On the other hand, a second flow rate evaluating portion 6 calculates a rate of change ΔD2 of the result D2 of performing the second smoothing process (Step S108). If the processing result of the previous cycle of the second smoothing processing portion 2 is $D2_{OLD}$, then the rate of change ΔD2 can be calculated through ($D2-D2_{OLD}$)/unit time (for example, 1 min). The second flow rate evaluating portion 6, when the ΔD2 calculated in Step S108 is an increasing trend when compared to the rate of change calculated the previous time (YES in Step S109), calculates the time R2 until the bacteria count arrives at an upper limit bacteria count NU, assuming that this rate of change ΔD2 will continue (Step S110). It is possible, of course, to calculate the time R2 as long as D2, which indicates the present bacteria count, and the rate of change ΔD2 thereof are known.

The second flow rate evaluating portion 6 obtains, from the bacteria reducing capability storing portion 4, the flow rate Vi_2 that corresponds to the largest required time of all of the required times that are smaller than $\alpha 2 \times R2$ (where $\alpha 2$ is a specific design constant) of those required times S2 that are stored in the bacteria reducing capability storing portion 4 (Step S111). The aforementioned bacteria reducing capability is given as the required time until the bacteria count is reduced by half from the upper limit bacteria count NU, and thus if the design is to $\alpha 2=1.0$, then it is fully possible to select a flow rate wherein there will be no problems. Note that in Step S109, if the rate of change ΔD2 does not have an increasing trend, then the updating of the flow rate Vi_2 through Step S110 and S111 is not performed, but rather the minimum flow rate is selected (Step S112).

A flow rate determining portion 7 selects, as the flow rate Vi into the controlled space, the maximum of the flow rates Vi_1, determined by the first flow rate evaluating portion 5, and the maximum of the flow rates Vi_2, determined by the second flow rate evaluating portion 6 (Step S113).

The air-conditioner, not shown, cools or heats air that is returned from the controlled space (the return air), or cools or heats mixed air, which is a mixture of return air and outside air, and sends it into the controlled space. The air (supply air) that is fed from the air-conditioner or a fan is sent into the controlled space after passing through an air cleaning filter. The airflow determining portion 7 controls the rotational speed of the fan of the air-conditioner or the blowing device so that the supply air flow rate will be the value Vi determined in Step S113.

The blowing controlling device repetitively executes the process illustrated in FIG. 2, above, with a specific period (or with specific timing). Note that for the purposes of temperature and humidity control, it would be effective to reduce the amount of air exchange; however air exchange for a germ-free space or a semi-germ-free space, essentially must be an airflow large enough for sterilization. That is, it is appropriate, and not a problem, to determine the airflow in accordance with the bacteria count alone.

As described above, in the present example, essentially a plurality of decisions is made based on smoothing processes using different smoothing time indices, and thus it is possible to take into consideration variability in the speed of change of the number of bacteria determine the flow rate, making it possible to perform safely the conservation of the air transporting power of the air-conditioner or blowing device in accordance with the degree of margin of the number of bacteria. In the present example it is possible to suppress waste of the air transporting power such as when the maximum flow rate is always selected.

Note that the numeric value of the bacteria reducing capability should be set through appropriate studies. Additionally, the method of expressing the bacteria reducing capability as a required time interval Si (minutes) until the bacteria count is reduced to half from the upper limit bacteria, count NU is merely an example, and there is no limited thereto insofar as it is a method for applying a bacteria reducing capability wherein the flow rate can be selected as appropriate.

Another example according to the present invention is explained next. FIG. 4 is a block diagram illustrating a structure of a blowing controlling device according to another example of the present invention, where structures identical to those of FIG. 1 are assigned identical codes. The blowing controlling device according to the example includes a bacteria count counting portion 1; a first smoothing processing portion 2; a second smoothing processing portion 3; a bacteria reducing capability storing portion 4; a first arrival time estimating portion 8 for estimating the time until the bacteria count arrives at an upper limit bacteria count, from the processing result of the first smoothing processing portion 2; a second arrival time estimating portion 9 for estimating the time until the bacteria count arrives at an upper limit bacteria count, from the processing result of the second smoothing processing portion 3; and a flow rate determining portion 7*a*, for referencing the bacteria reducing capability storing portion 4, to select a flow rate that matches a bacteria producing capability that is compatible with the increase in the bacteria count that is forecasted from the time estimated by the first arrival time estimating portion 8 and the time that is estimated by the second arrival time estimating portion 9.

Figure 5:
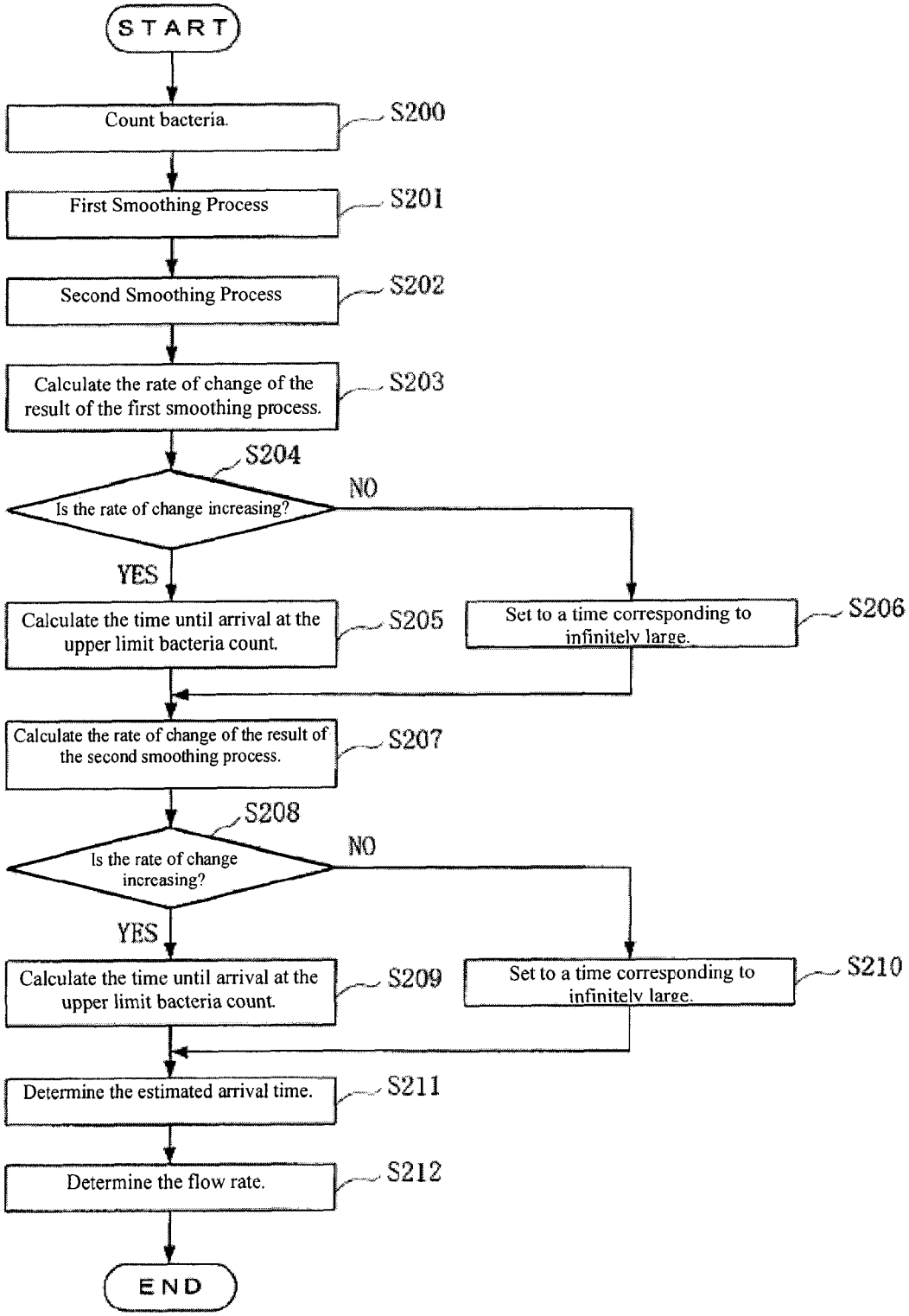
FIG. 5 is a flowchart illustrating the operation of the blowing controlling device according to the other example of the present invention.

FIG. 5 is a flowchart illustrating the operation of an airflow controlling device according to the present example. The processes in Step S200 through S202 in FIG. 5 are identical to those in Step S100 through S102 in FIG. 2.

A first arrival time estimating portion 8 calculates a rate of change ΔD1 of the result D1 of executing the first smoothing process (Step S203). The first arrival time estimating portion 8, when the ΔD1 calculated in Step S203 is an increasing trend when compared to the rate of change calculated the previous time (YES in Step S204), calculates the time R1 until the bacteria count arrives at an upper limit bacteria count NU, assuming that this rate of change ΔD1 will continue (Step S205). The processes in Step S203 through S205 are identical to those in Step S103 through S105 in FIG. 2, Note that if the rate of change ΔD1 in Step S204 is not an increasing trend, that the time R1 is not calculated in Step S205, and the time R1 is set to a time corresponding to being infinitely large (for example, 10,000 min.) (Step S206).

A second arrival time estimating portion 9 calculates a rate of change ΔD2 of the result D2 of executing the second smoothing process (Step S207). The second arrival time estimating portion 9, when the ΔD2 calculated in Step S207 is an increasing trend when compared to the rate of change calculated the previous time (YES in Step S208), calculates the time R2 until the bacteria count arrives at an upper limit bacteria count NU, assuming that this rate of change ΔD2 will continue (Step S209). The processes in Step S207 through S208 are identical to those in Step S108 through S110 in FIG. 2. Note that the rate of change ΔD2 in Step S208 is not an increasing trend, that the time R2 is not calculated in Step S209, and the time R2 is set to a time corresponding to being infinitely large (for example, 10,000 min.) (Step S210).

The flow rate determining portion 7*a* selects, as the arrival estimated time RX, the smallest of the time R1 calculated by the first arrival time estimating portion 8 and the time R2 calculated by the second arrival time estimating portion 9 (Step S211). Doing so makes it possible to take variability into account when performing the estimated arrival time calculations. Additionally, the flow rate determining portion 7*a* obtains, from the bacteria reducing capability storing portion 4, the flow rate V that corresponds to the largest required time of all of the required times that are smaller than $\alpha \times RX$ (where $\alpha$ is a specific design constant) of those required times S1 that are stored in the bacteria reducing capability storing portion 4, and sets this Vi as the flow rate Vi into the controlled space (Step S212). The aforementioned bacteria reducing capability is given as the required time until the bacteria count is reduced by half from the upper limit bacteria count NU, and thus if the design is to $\alpha=1.0$, then it is fully possible to select a flow rate wherein there are no problems.

As with the example above, the air (supply air) sent from the air-conditioner or blowing device, not shown, is sent into the controlled space after passing through the air cleaning filter. The airflow determining portion 7*a* controls the rotational speed of the fan of the air-conditioner or the blowing device so that the supply air flow rate will be the value Vi determined in Step S212.

The blowing controlling device repetitively executes the process illustrated in FIG. 5, above, with a specific period (or with specific timing).

Figure 6:
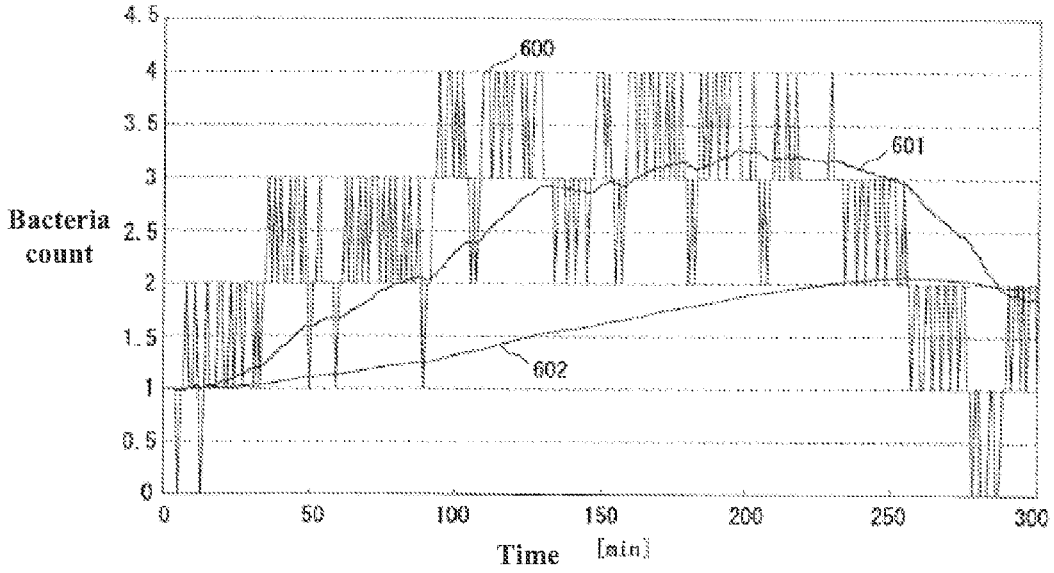
FIG. 6 is a diagram illustrating examples of a bacteria count counting value and a smoothing process result in the other example of the present invention.
Figure 7:
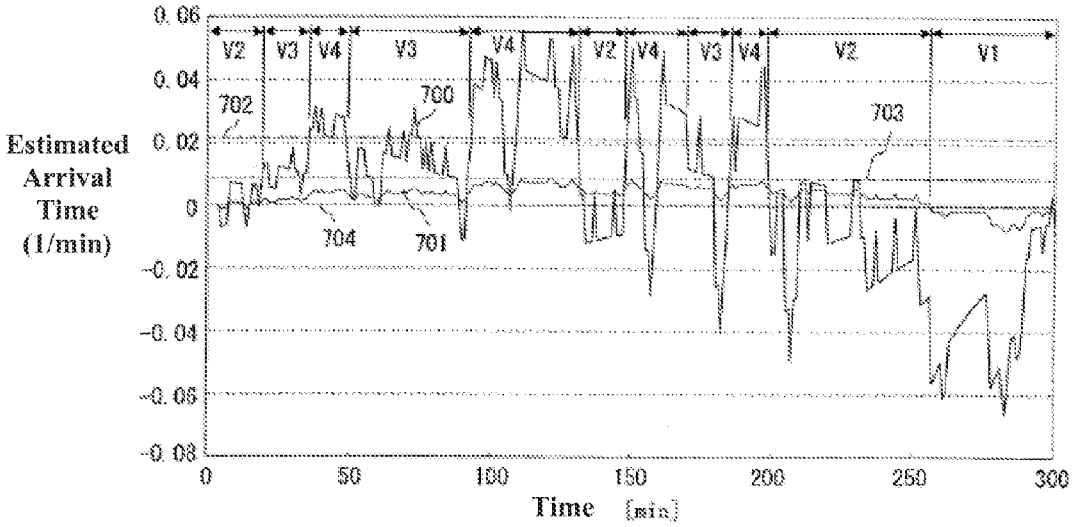
FIG. 7 is a diagram illustrating an example of calculation of an expected arrival time in the other example.

FIG. 6 and FIG. 7 are diagrams illustrating an example of operation in the present example, where FIG. 6 is a diagram illustrating an example of the bacteria count counted values and the smoothing process results over a 300 min. interval. 600 in FIG. 6 is the bacteria count measured values at each unit time (1 min.) by the bacteria count counting portion 1, obtained in counting numbers 0, 1, 2, 3, and 4. 601 is the first smoothing process result D1 by the first smoothing processing portion 2, and indicates the result of performing the smoothing process by a one-stage filter with a time constant T1=41 min. on the bacteria count counting result. 602 is the second smoothing process result D2 by the second smoothing processing portion 3, and indicates the result of performing the smoothing process by a one-stage filter with a time constant T2=298 min. on the bacteria count counting result.

FIG. 7 is a diagram illustrating an example of calculation of the estimated arrival time until the arrival of the bacteria count at the upper limit bacteria count NU. Note that in FIG. 7 the estimated arrival time is shown as inverse numbers for convenience in display. 700 is the inverse of the estimated arrival time R1 calculated by the first flow rate evaluating portion 5 based on the first smoothing processing result D1, 701 is the inverse of the estimated arrival time R2 calculated by the second flow rate evaluating portion 6 based on the second smoothing processing result D2. 702 shows the borderline of the inverse of 41 min., 703 shows the borderline of the inverse of 126 min., and 704 shows the borderline of the inverse of 298 min.

If the inverses of the estimated arrival times R1 and R2 are less than the borderline of the inverse of 298 min., that is, if the estimated arrival times R1 and R2 are greater than 298 min., then the flow rate V1=0.50 $m^3$/min, corresponding to the maximum required time of 298 min, of the required times Si stored in the bacteria reducing capability storing portion 4 is selected.

If the inverses of the estimated arrival times R1 and R2 are more than the borderline of the inverse of 298 min., and less than the borderline of the inverse of 126 min., that is, if the estimated arrival times R1 and R2 are less than 298 and greater than 126 min., then the flow rate V2=1.50 $m^3$/min, corresponding to the maximum required time of 126 min. of the required times Si that are less than 298 min. stored in the bacteria reducing capability storing portion 4, is selected.

If the inverses of the estimated arrival times R1 and R2 are more than the borderline of the inverse of 126 min., and less than the borderline of the inverse of 41 min., that is, if the estimated arrival times R1 and R2 are less than 126 and greater than 41 min., then the flow rate V3=4.50 $m^3$/min, corresponding to the maximum required time of 41 min. of the required times Si that are less than 126 min. stored in the bacteria reducing capability storing portion 4, is selected.

If the inverses of the estimated arrival times R1 and R2 are greater than the borderline of the inverse of 41 min., that is, if the estimated arrival times R1 and R2 are less than 41 min, then the flow rate V4=10.0 $m^3$/min., corresponding to the maximum required time of 15 min. of the required times Si that are less than 41 min. stored in the bacteria reducing capability storing portion 4 is selected.

In FIG. 7, in the vicinity of the time mark at 135 min., the inverses of the estimated arrival times R1 are mostly larger than the inverses of the estimated arrival times R2, that is, the estimated arrival times R1 are mostly shorter than the estimated arrival times R2, and the flow rates selected by the first flow rate evaluating portion 5 are mostly greater than the flow rates selected by the second flow rate evaluating portion 6. Because of this, the flow rate determining portion 7 sets the flow rate Vi into the controlled space to be the flow rate selected by the first flow rate evaluating portion 5.

Next, from the vicinity of the time mark at 135 min. to the vicinity of the time mark at 148 min., the inverses of the estimated arrival times R2 are mostly larger than the inverses of the estimated arrival times R1, that is, the estimated arrival times R2 are mostly shorter than the estimated arrival times R1, and the flow rates selected by the second flow rate evaluating portion 6 are mostly greater than the flow rates selected by the first flow rate evaluating portion 5. Because of this, the flow rate determining portion 7 sets the flow rate Vi into the controlled space to be the flow rate selected by the second flow rate evaluating portion 6.

Between the time mark at 148 min. and the time mark at 200 min., the inverses of the estimated arrival times R1 are mostly larger than the inverses of the estimated arrival times R2, that is, the estimated arrival times R1 are mostly shorter than the estimated arrival times R2. Because of this, the flow rate determining portion 7 sets the flow rate Vi into the controlled space to be the flow rate selected by the first flow rate evaluating portion 5.

After the time mark at 200 min., the inverses of the estimated arrival times R2 are mostly larger than the inverses of the estimated arrival times R1, that is, the estimated arrival times R2 are mostly shorter than the estimated arrival times R1. Because of this, the flow rate determining portion 7 sets the flow rate Vi into the controlled space to be the flow rate selected by the second flow rate evaluating portion 6.

The operation of this example is essentially identical to that in the above example, and can produce the same effects as in the above example.

Note that the blowing controlling devices as set forth in the examples may be embodied through, for example, a computer comprising a CPU, a memory device, and an interface to the outside, and through a program for controlling these hardware resources. The CPU executes the processes explained in the first and second forms of embodiment, in accordance with a program that is stored in the memory device.

The present invention can be applied to technologies for conserving air transporting power of air-conditioners or blowing devices in air-conditioning systems equipped with bacteria reducing means.

The invention claimed is:

1. An airflow controlling device comprising:

a bacteria counter that counts bacteria in a controlled space and obtains a bacteria count;

a first smoothing processing unit that processes the bacteria count using a predetermined first smoothing time index;

a second smoothing processing unit that processes the bacteria count using a predetermined second smoothing time index;

a bacteria reducing capability storage that stores in advance a bacteria reducing capability of a bacteria reducing device, relative to each flow rate of airflow into the controlled space;

a first flow rate evaluator that references the bacteria reducing capability storage to select a flow rate matching a bacteria reducing capability compatible with an increase in bacteria forecasted from a processing result of the first smoothing processing unit;

a second flow rate evaluator that references the bacteria reducing capability storage to select a flow rate matching a bacteria reducing capability compatible with an increase in bacteria forecasted from a processing result of the second smoothing processing unit; and a flow rate determining device that selects a flow rate of airflow into the controlled space based on the flow rate selected by the first flow rate evaluator and the flow rate selected by the second flow rate evaluator.

2. The airflow controlling device as set forth in claim 1, wherein:

the bacteria reducing capability is expressed as a time required to reduce the bacteria count in the controlled space from an upper limit bacteria count to a specific proportion.

3. The airflow controlling device as set forth in claim 1, wherein:

the first smoothing processor is a first data smoothing processor; and the second smoothing processor is a second data smoothing processor.

4. The airflow controlling device as set forth in claim 3, wherein:

the first data smoothing processor is a first one-stage-delay-filter smoothing processor; and the second data smoothing processor is a second one-stage-delay-filter smoothing processor.

5. The airflow controlling device as set forth in claim 1, wherein:

the predetermined first smoothing time index is determined in advance based on rates of changes in the bacteria counts obtained from past data.

6. The airflow controlling device as set forth in claim 1, wherein:

the predetermined second smoothing time index is determined in advance based on rates of changes in the bacteria counts obtained from past data.

7. An airflow controlling device comprising:

a bacteria counter that counts bacteria in a controlled space and obtains a bacteria count;

a first smoothing processor that processes the bacteria count using a predetermined first smoothing time index;

a second smoothing processor that processes the bacteria count using a predetermined second smoothing time index;

a bacteria reducing capability storage that stores storing in advance a bacteria reducing capability of a bacteria reducing device, relative to each flow rate of airflow into the controlled space;

a first arrival time estimator that estimates a time until arrival of the bacteria count at an upper limit bacteria count, from a processing result by the first smoothing processor;

a second arrival time estimator that estimates a time until arrival of the bacteria count at an upper limit bacteria count, from a processing result by the second smoothing processor; and a flow rate determining device that references the bacteria reducing capability storage, selects a flow rate that matches a bacteria reducing capability able to handle an increase in the bacteria count that is forecasted from the time estimated by the first arrival time estimator and the time estimated by the second arrival time estimator, and defines the selected flow rate as the flow rate of airflow into the controlled space.

8. The airflow controlling device as set forth in claim 7, wherein:

the bacteria reducing capability is expressed as a time required to reduce the bacteria count in the controlled space from an upper limit bacteria count to a specific proportion.

* * * * *